US006949701B2

(12) United States Patent
Okumura

(10) Patent No.: US 6,949,701 B2
(45) Date of Patent: Sep. 27, 2005

(54) DRUMHEAD

(75) Inventor: Yukimasa Okumura, Hamamatsu (JP)

(73) Assignee: Yamaha Corporation, Shizuoka-ken (JP)

( * ) Notice: Subject to any disclaimer, the term of this patent is extended or adjusted under 35 U.S.C. 154(b) by 76 days.

(21) Appl. No.: 10/345,299

(22) Filed: Jan. 16, 2003

(65) Prior Publication Data

US 2003/0136244 A1 Jul. 24, 2003

(30) Foreign Application Priority Data

Jan. 18, 2002 (JP) ..... P2002-010073

(51) Int. Cl.[7] ..... G10D 13/02

(52) U.S. Cl. ..... 84/411 R; 84/414; 84/418; 84/419; 84/420

(58) Field of Search ..... 84/411 R, 414, 84/415, 418, 419, 420

(56) References Cited

U.S. PATENT DOCUMENTS

| | | | | |
|---|---|---|---|---|
| 5,159,139 | A | 10/1992 | Beals | |
| 5,864,077 | A | 1/1999 | Gatzen | |
| 6,245,979 | B1 * | 6/2001 | Campbell | 84/411 M |
| 6,525,249 | B1 * | 2/2003 | Suenaga | 84/411 R |

FOREIGN PATENT DOCUMENTS

| | | |
|---|---|---|
| JP | 64-54096 | 4/1989 |
| JP | 08-305350 | 11/1996 |
| JP | 8-314381 | 11/1996 |

OTHER PUBLICATIONS

Japanese Office Action issued Dec. 14, 2004 (w/ English translation of relevant portions).

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

A drumhead for use in a percussion instrument is composed of multiple (e.g., two or three) plies of synthetic resin films, which are laminated together and are brought into close contact with each other when stretched across the opening of a hollow cylinder of a drum, for example. At least one air evacuation hole is formed at the center of the backside synthetic resin film or in proximity to the center of the backside synthetic resin film. Therefore, when the drumhead is stretched outwardly along a diameter direction of the opening of the hollow cylinder of the drum, remaining air between the films can be reliably evacuated from the air evacuation hole towards the exterior of the drumhead. Thus, it is possible to reduce unwanted loss in transmission of vibration between the films of the drumhead when beaten; hence, it is possible to realize good sound quality in the drum.

6 Claims, 4 Drawing Sheets

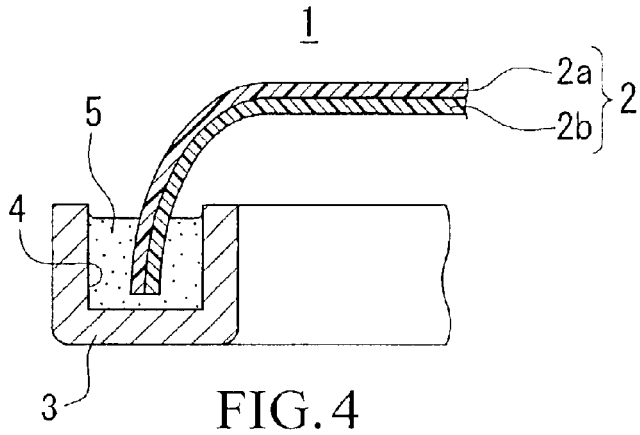
FIG. 4
FIG. 5A
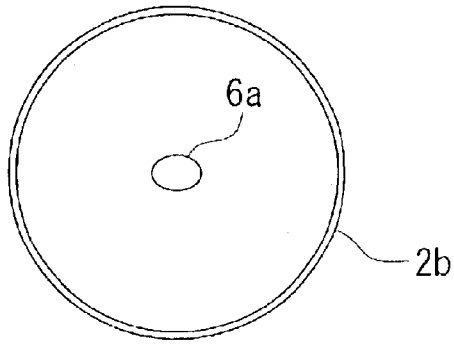
FIG. 5B
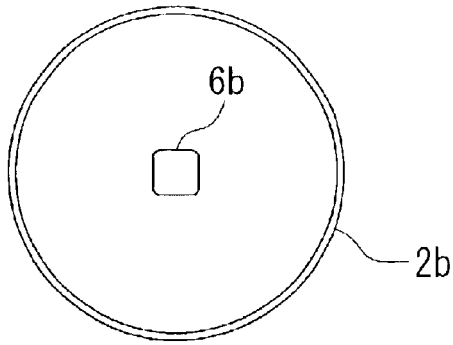
FIG. 5C
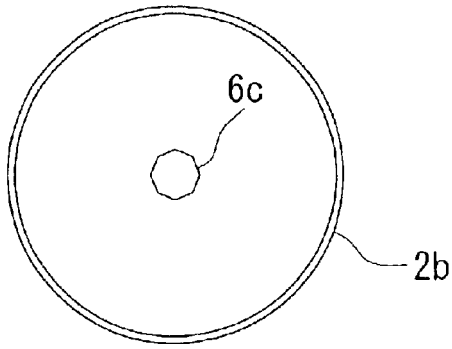

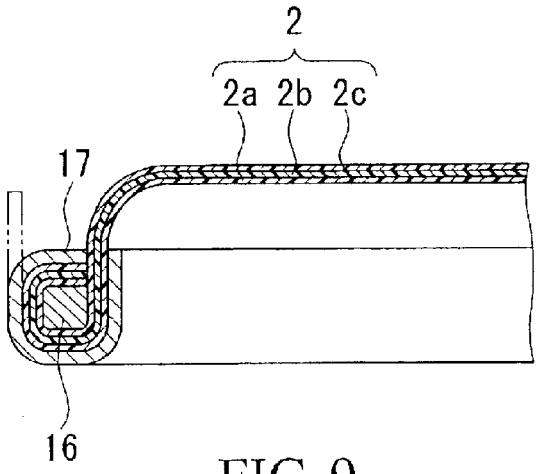
FIG. 9
| SIZES OF DRUMHEADS (INCHES) | PERCENTAGES (%) IN POSITIONAL DEVIATIONS OF AIR EVACUATION HOLES |
|---|---|
| 6 | 49 |
| 8 | 58 |
| 10 | 64 |
| 12 | 68 |
| 13 | 69.5 |
| 14 | 70 |
FIG. 10
PERCENTAGE (%) IN POSITIONAL DEVIATION OF AIR EVACUATION HOLE = d/D*100
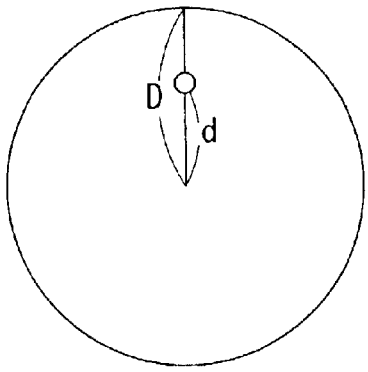
FIG. 11

DRUMHEAD

BACKGROUND OF THE INVENTION

1. Field of the Invention

This invention relates to drumheads composed of multiple plies of synthetic resin films.

2. Description of the Related Art

In general, drums are made of hollow cylinders whose openings are covered with stretched skins, that is, drumheads. In particular, drumheads composed of synthetic resin films can be manufactured at relatively low cost and are therefore advantageous in mass production in comparison with drumheads composed of natural leathers. In addition, synthetic-resin drumheads are hardly influenced by environmental factors such as variations in temperature and humidity. Furthermore, they produce relatively "hard" sounds and are characterized in that tone pitches and tone colors are difficult to be varied. Generally, synthetic-resin drumheads are each composed of one or two plies of synthetic resin films. Drumheads each composed of a one-ply synthetic resin film are characterized in having good responses and are capable of producing sound components of higher frequencies. There may be provided three types of drumheads, each composed of two plies of synthetic resin films, as follows:

(1) Two synthetic resin films are merely disposed one over the other.

(2) Two synthetic resin films are joined in such a way that outer peripheries thereof are adhered to each other by adhesive while center portions thereof are brought into close contact with each other.

(3) Two synthetic resin films are joined in such a way that the entire areas thereof are completely adhered to each other by adhesive.

In addition, it is possible to paint patterns on surfaces of films, which contribute to variations in sounds produced by drums.

In conventional drumheads, each composed of multiple plies of synthetic resin films that are laminated together and are merely brought into close contact with each other, when small amounts of air remain between films in the manufacture of drumheads, the entire areas of the films cannot be brought into complete close contact with each other, which may cause unwanted loss in transmission of vibrations that occur when drumheads are beaten by drumsticks and the like. There is a problem in that unwanted variations may occur in sound qualities in drums; therefore, it is very difficult to manufacture drumheads having stable sound qualities.

SUMMARY OF THE INVENTION

It is an object of the invention to provide a drumhead composed of multiple plies of synthetic resin films that are laminated together, wherein air can be completely evacuated from 'laminated' synthetic resin films so that transmission loss of vibration can be extremely reduced. In addition, this invention provides a drumhead having a good sound quality, which can be manufactured easily.

A drumhead of this invention is basically composed of multiple (e.g., two or three) plies of synthetic resin films, which are laminated together and are brought into close contact with each other when stretched across the opening of a hollow cylinder of a drum. Herein, at least one air evacuation hole is formed at the center of the backside synthetic resin film or in proximity to the center of the backside synthetic resin film. Therefore, when the drumhead is stretched outwardly along a diameter direction of the opening of the hollow cylinder of the drum, air remaining between the films can be reliably evacuated from the air evacuation hole towards the exterior of the drumhead.

Thus, it is possible to reduce unwanted loss in transmission of vibrations between the films of the drumhead when beaten; hence, it is possible to realize good sound quality in the drum.

Incidentally, multiple air evacuation holes can be formed around the center of the backside synthetic resin film. In addition, the air evacuation hole is not necessarily limited to a circular shape; hence, it is possible to use other shapes such as oval shapes, rectangular shapes, and octagonal shapes for the air evacuation hole.

BRIEF DESCRIPTION OF THE DRAWINGS

These and other objects, aspects, and embodiments of the present invention will be described in more detail with reference to the following drawings, in which:

FIG. 4 is an enlarged cross sectional view of an end portion B of the drumhead of FIG. 1;

FIG. 5A diagrammatically shows a backside synthetic resin film having an oval hole at the center;

FIG. 5B diagrammatically shows a backside synthetic resin film having a rectangular hole at the center;

FIG. 5C diagrammatically shows a backside synthetic resin film having an octagonal hole at the center;

FIG. 9 is a cross sectional view showing an example of a holding structure for holding the outer periphery of the drumhead;

FIG. 10 shows relationships between prescribed sizes of drumheads and percentages in positional deviations of air evacuation holes; and FIG. 11 diagrammatically shows parameters for use in calculations of percentages in positional deviations of air evacuation holes, each of which is measured from the center of the drumhead.

DESCRIPTION OF THE PREFERRED EMBODIMENTS

This invention will be described in further detail by way of examples with reference to the accompanying drawings.

Figure 1:
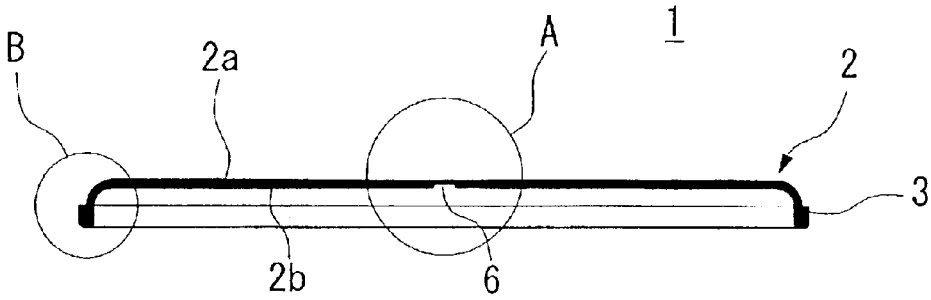
FIG. 1 is a cross sectional view showing a laminated structure of a drumhead composed of two plies of synthetic resin films in accordance with a first embodiment of the invention.
Figure 2:
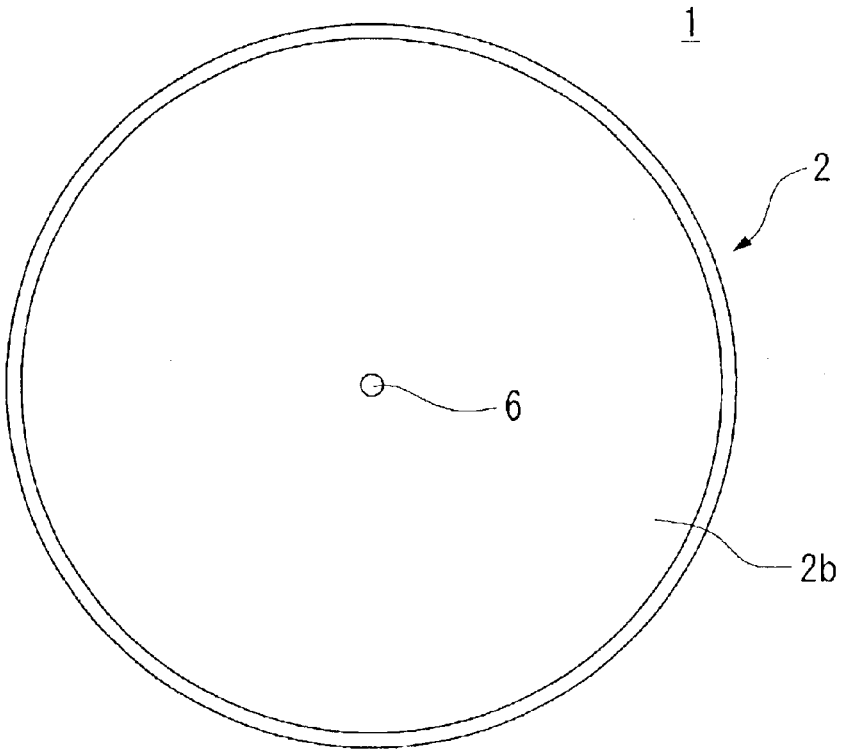
FIG. 2 is a bottom view of the drumhead of FIG. 1.
Figure 3:
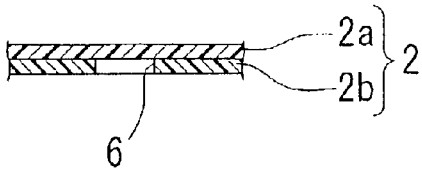
FIG. 3 is an enlarged cross sectional view of a center portion A of the drumhead of FIG. 1.

FIG. 1 is a cross sectional view showing a laminated structure of a drumhead in accordance with the first embodiment of the invention. FIG. 2 is a bottom view of the drumhead; FIG. 3 is an enlarged cross sectional view of a center portion A of the drumhead of FIG. 1; FIG. 4 is an enlarged cross sectional view of an end portion B of the drumhead of FIG. 1. In particular, the drumhead of the present embodiment is composed of two plies of synthetic resin films. That is, a drumhead 1 is composed of two plies of synthetic resin films 2*a* and 2*b* (both represented by the same reference numeral "2"), which are laminated together and are both formed in the same size and in the same dimensions. Outer peripheries of the films 2 are inserted into the hollow of a ring channel 4 of a head frame 3 and are adhered using adhesive 5.

Each of the synthetic resin films 2 is made of a prescribed synthetic resin film such as a polyester film or a polyethylene terephthalate film, which has a prescribed thickness that may range from 50 $\mu$m to 350 $\mu$m, for example. In order to allow evacuation of remaining air between the synthetic resin films 2*a* and 2*b* towards the exterior of the drumhead 1, a small hole 6 exclusively for use in evacuation of air (hereinafter, simply referred to as an air evacuation hole 6) is formed at the center of the backside synthetic resin film 2*b*. The air evacuation hole 6 has a prescribed diameter, which approximately ranges from 1 mm to 3 mm, for example. The air evacuation hole 6 is not necessarily limited to the circular shape shown in FIG. 2. Therefore, it is possible to employ other shapes for the air evacuation hole 6, examples of which are shown in FIGS. 5A to 5C. That is, an air evacuation hole 6*a* having an elliptical or oval shape can be formed at the center of the backside film 2*b* as shown in FIG. 5A; an air evacuation hole 6*b* having a rectangular shape whose corners are curved in order to avoid concentration of stress can be formed at the center of the backside film 2*b* as shown in FIG. 5B; or an air evacuation hole 6*c* having an octagonal shape can be formed at the center of the backside film 2*b* as shown in FIG. 5C. Thus, it possible to arbitrarily select an appropriate shape for the air evacuation hole 6 formed at the center of the backside film 2*b*.

Reasons why the air evacuation hole 6 is formed at the center of the backside synthetic resin film 2*b* will be described below.

When the head frame 3 is clamped and pressed by a clamping frame (not shown), the outer periphery of the drumhead 1 is supported by the circumferential end of an opening of a cylindrical body of a drum, so that a gap (or gaps) may be very likely formed between the center portions of the synthetic resin films 2*a* and 2*b*. For this reason, the air evacuation hole 6 is formed at the center of the backside synthetic resin film 2*b* in order to secure communication with such a gap (or gaps) that may be very likely formed between the center portions of the synthetic resin films 2*a* and 2*b*. Incidentally, it is not necessarily limited such that only one air evacuation hole 6 is formed with respect to the backside synthetic resin film 2*b*; therefore, it is possible to form multiple small holes for evacuation of air in order to raise air evacuating effects with respect to the drumhead. For example, multiple small holes may be arranged on the backside synthetic resin film 2*b* in such a way that one small hole is formed at the center of the backside synthetic film 2*b*, and a prescribed number of small holes may be arranged in a concentric manner around the "center" hole and be circumferentially arranged with equal distances therebetween.

Incidentally, the air evacuation hole is not necessarily formed at the center of the synthetic resin film of the drumhead, and it can be formed at a certain position in the center area of the synthetic resin film that can assure effective evacuation of air. Through studies and experiments, it is confirmed that remaining air can be reliably and effectively evacuated from the air evacuation hole that is formed at a certain position deviated from the center of the drumhead, examples of which are shown in FIGS. 10 and 11. That is, FIG. 10 shows relationships between prescribed sizes of drumheads and percentages in positional deviations of air evacuation holes, which are calculated by an expression of "d/D*100", wherein "D" represents a radius of the drumhead, and "d" represents a positional deviation of the air evacuation hole measured from the center of the drumhead (see FIG. 11). FIG. 10 shows that the percentage may not exceed 75%, in other words, it may range within 75% of the radius measured from the center of the drumhead. Preferably, it may range from 45% to 75%, for example.

As described above, the drumhead 1 of the present embodiment is characterized in that the air evacuation hole 6 is formed on the backside synthetic resin film 2*b*. Therefore, when the head frame 3 is clamped and pressed by a clamping frame (not shown) so that the outer periphery of the drumhead 1 is pressed to the circumferential end of an opening of a cylinder body of a drum to impart a prescribed tension to the drumhead 1, both the synthetic resin films 2*a* and 2*b* are stretched outwardly along a diameter direction of the opening of the cylinder body and are mutually brought into close contact with each other, so that a very small amount of air may remain between the films 2*a* and 2*b* but is surely evacuated downwardly from the air evacuation hole 6 of the backside synthetic resin film 2*b*. This guarantees that the synthetic resin films 2*a* and 2*b* can be brought into complete close contact with each other without causing unwanted formation of an air layer between the films 2*a* and 2*b*. Hence, vibrations that occur on the front-side synthetic resin film 2*a* when beaten by a drumstick and the like can be optimally transmitted to the backside synthetic resin film 2*b*, so that both the films 2*a* and 2*b* can be vibrated together to assure good sound quality from the drum.

A lamination of the synthetic resin films 2 is manufactured by pressing the two synthetic resin films 2*a* and 2*b*, one being placed above the other and the films being placed into a specific mold (not shown). By such a manufacturing process, remaining air between the laminated synthetic resin films 2 can be reliably evacuated from the air evacuation hole 6 to the exterior. Therefore, it is possible to form the drumhead 1 composed of the laminated synthetic resin films 2 smoothly and uniformly over the entire area thereof without causing unexpected formation of wrinkles or partial twisting thereon. That is, the present embodiment is advantageous in manufacturability.

In the present embodiment, the two synthetic resin films 2*a* and 2*b* are merely brought into close contact with each other and are not adhered together using the adhesive. Therefore, the present embodiment has a richness in flexibility and is capable of producing 'soft' sounds like leather drumheads. In addition, relative deviations are caused to occur between the laminated films 2 during the playing of a drum, which may assure rapid attenuation (or damping) of sound components of broad bands. That is, it is possible to produce "sharp" sound in the drum.

Figure 6:
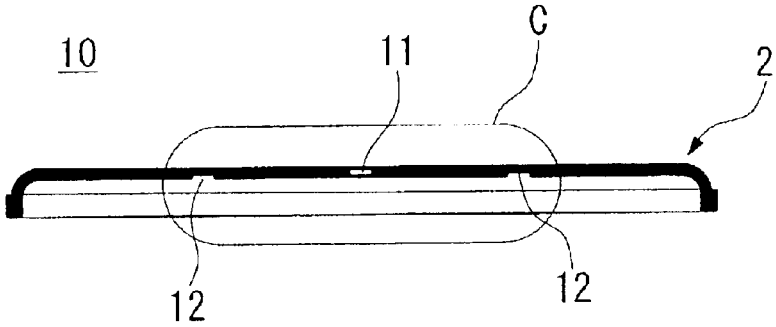
FIG. 6 is a cross sectional view showing a laminated structure of a drumhead composed of three plies of synthetic resin films in accordance with a second embodiment of the invention.
Figure 7:
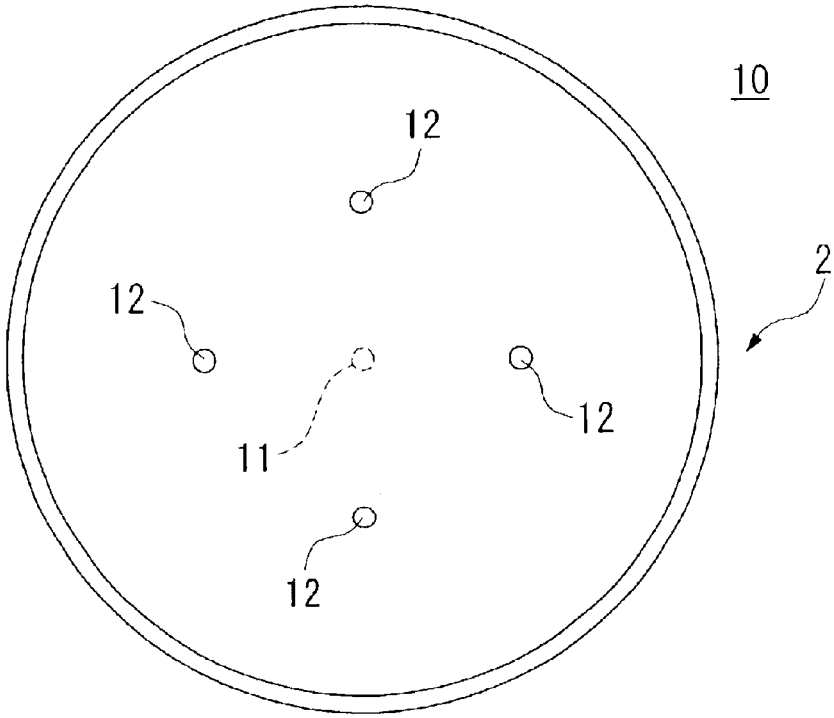
FIG. 7 is a bottom view of the drumhead of FIG. 6.
Figure 8:
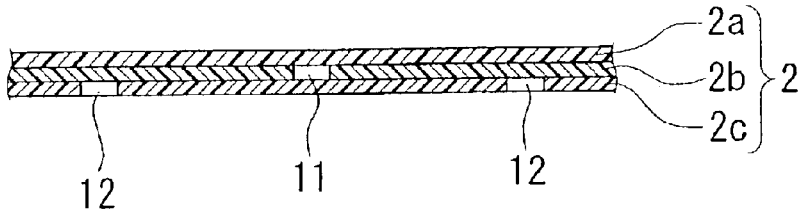
FIG. 8 is an enlarged cross sectional view of a center portion C of the drumhead of FIG. 6.

FIG. 6 is a cross sectional view showing a laminated structure of a drumhead in accordance with the second embodiment of the invention; FIG. 7 is a bottom view of the drumhead shown in FIG. 6; and FIG. 8 is an enlarged cross sectional view of a center portion C of the drumhead of FIG. 6. That is, the second embodiment provides a drumhead 10 composed of three plies of synthetic resin films 2*a*, 2*b*, and 2*c*, which are laminated together and are all formed in the same size and dimensions. Similar to the drumhead 10 of FIG. 1, the outer periphery of the drumhead 10 is inserted into the hollow of a ring channel of a head frame 3 as shown in FIG. 4 and is securely fixed to the head frame 3 by adhesive 5.

Air evacuation holes 11 and 12 are respectively formed at prescribed positions of the synthetic resin films 2*b* and 2*c* except the front-side synthetic resin film 2*a*. Specifically, a single air evacuation hole 11 is formed at the center of the intermediate synthetic resin film 2*b*, and four air evacuation holes 12 are formed at prescribed positions of the backside synthetic resin film 2*c* in such a way that they are arranged concentrically around the 'center' air evacuation hole 11 of the intermediate synthetic resin film 2*b* and be circumferentially arranged with prescribed distances therebetween. FIG. 7 shows that all the air evacuation holes 11 and 12 have circular shapes, which is illustrative and not restrictive. That is, similarly to the foregoing embodiment, it is possible to employ appropriate shapes such as oval shapes, rectangular shapes, and octagonal shapes (see FIGS. 5A, 5B, and 5C) for the air evacuation holes 11 and 12. In addition, the present embodiment is not necessarily designed such that only a single air evacuation hole 11 is formed at the center of the intermediate synthetic resin film 2*b*. That is, similarly to the backside synthetic resin film 2*c* having multiple air evacuation holes 12, it is possible to form multiple air evacuation holes with respect to the intermediate synthetic resin film 2*b*.

Similarly to the foregoing embodiment, the drumhead 10 is supported by the head frame 3 and is stretched with tension across the opening of the cylinder body of the drum, so that all the three synthetic resin films 2*a*, 2*b*, and 2*c* are stretched outwardly along a diameter direction of the opening of the cylinder body and are mutually brought into close contact with each other. Therefore, air remaining between the films 2*a*, 2*b*, and 2*c* can be reliably evacuated from the air evacuation holes 11 and 12 towards the exterior of the drumhead 10.

The aforementioned embodiments are described with respect to drumheads composed of two and three plies of synthetic resin films, which is illustrative and not restrictive. Hence, this invention can be easily applied to other types of drumheads composed of three or more plies of synthetic resin films. Practically, the number of synthetic resin films for use in the drumhead may range from two to five, for example. As the number of synthetic resin films is increased, the synthetic resin films are each reduced in thickness. In addition, the aforementioned embodiments are described in such a way that all the synthetic resin films have substantially the same thickness. Of course, it is possible to arbitrarily change the thickness of the synthetic resin films. By adequately changing the thickness of the synthetic resin films, it is possible to realize a variety of applications for the drumhead; in other words, it is possible to produce various types of drumheads suited for drums used in marching bands, drums or other percussion instruments (e.g., kettledrums, congas, etc.) used in concerts, and the like.

Furthermore, the aforementioned embodiments are described in such a way that the outer peripheries of the synthetic resin films laminated together are held and inserted into the ring channel 4 of the head frame 3 and are fixed to the head frame 3 by the adhesive 5, which is illustrative and not restrictive. That is, it is possible to employ other types of holding structures for holding the outer periphery of the drumhead. For example, it is possible to employ a holding structure shown in FIG. 9 in which the outer periphery of the drumhead composed of three plies of synthetic resin films 2*a*, 2*b*, and 2*c*, which are laminated together, is wound about an iron or aluminum core material 16, which is then fixed in position by an outer frame 17 having a ring shape, which is made of a prescribed material such as aluminum. The outer frame 17 is firstly formed in a reversed shape of a numeral "7" in cross section, which is shown by dashed lines in FIG. 9, so that after the core material 16 is completely inserted into a ring-shaped channel, the extended end portion (encompassed by dashed lines) of the outer frame 17 is bent inwardly, thus substantially encompassing the core material 16. Thus, the core material 16 about which the outer periphery of the drumhead is wound is completely placed in the hollow space of the outer frame 17, which is finally shaped like a rectangle in cross section. Herein, it is possible to put the adhesive into the hollow space of the outer frame 17 in advance, so that the core material 16 is automatically fixed in position within the hollow space of the outer frame 17.

As described heretofore, this invention has a variety of technical features and effects, which will be described below.

(1) This invention basically relates to a laminated structure of a drumhead composed of multiple plies of synthetic resin films, which are laminated together and are stretched across the opening of a cylinder body of a drum, wherein at least one air evacuation hole is formed at a prescribed position of the backside synthetic resin film(s) except the front-side synthetic resin film in order to allow evacuation of air remaining between the synthetic resin films.

(2) When the drumhead is supported and stretched with tension across the opening of the cylinder body of the drum, all the synthetic resin films are stretched outwardly along a diameter direction of the cylinder body and are mutually brought into close contact with each other. Therefore, air remaining between the films can be reliably evacuated from the air evacuation hole(s) towards the exterior of the drumhead. Thus, it is possible to reduce transmission loss of vibrations between the films, which contributes to an improvement of sound quality from the drum.

(3) The drumhead of this invention can be easily manufactured by pressing multiple synthetic resin films, which are laminated together and are put into a mold. Therefore, it is possible to reliably avoid unwanted or unexpected formation of wrinkles or partial twisting of the films due to evacuation of air. That is, it is possible to produce a drumhead composed of the laminated synthetic resin films smoothly and uniformly.

(4) Preferably, the diameter of the air evacuation hole is set to approximately 3 mm, for example. In addition, it may be preferable that the air evacuation hole be formed at the center of the backside synthetic resin film or in proximity to the center of the backside synthetic resin film.

(5) The drumhead of this invention can be easily manufactured by forming at least one small hole for evacuation of air remaining at a prescribed position of the backside synthetic resin film; therefore, it is possible to effectively use the "existing" synthetic resin films for use in the drumhead.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A drumhead for use in a percussion instrument, comprising:

a plurality of synthetic resin films, which are laminated together and are brought into close contact with each other when stretched across an opening of a hollow cylinder of the percussion instrument; and at least one air evacuation hole that is formed substantially at the center of a backside synthetic resin film within the plurality of synthetic resin films or that is formed in proximity to the center of the backside synthetic resin film, wherein air remaining between the plurality of synthetic resin films is evacuated from the air evacuation hole when the plurality synthetic resin films are stretched outwardly along a diameter direction of the hollow cylinder.

2. A drumhead according to claim 1, wherein the air evacuation hole has a prescribed shape, which is selected from among a circular shape, an oval shape, a rectangular shape, and an octagonal shape.

3. A drumhead according to claim 1, wherein when three or more synthetic resin films are laminated together, air evacuation holes are respectively formed at prescribed positions of the synthetic resin films except a front-side synthetic resin film.

4. A drumhead comprising:

a plurality of synthetic resin films, which are joined together; and at least one air evacuation hole that is formed at a prescribed position of the synthetic resin film within the plurality of synthetic resin films except a front-side synthetic resin film.

5. A drumhead according to claim 4, wherein the air evacuation hole is formed at the prescribed position that is deviated from the center of the synthetic resin film within 75% of a prescribed radius.

6. A drumhead according to claim 4, wherein the air evacuation hole is formed at the prescribed position of the synthetic resin film within a range from 45% to 75% of a prescribed radius.

* * * * *